US008624913B2

(12) United States Patent
Manabe

(10) Patent No.: US 8,624,913 B2
(45) Date of Patent: Jan. 7, 2014

(54) DISPLAY CONTROL APPARATUS AND DISPLAY CONTROL METHOD THAT DETERMINES A PLURALITY OF REGIONS IN A FRAME TO BE DISPLAYED AT DIFFERENT FRAME RATES THAN ONE ANOTHER

(75) Inventor: Yoshihiro Manabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 776 days.

(21) Appl. No.: 12/621,389

(22) Filed: Nov. 18, 2009

(65) Prior Publication Data

US 2010/0128054 A1 May 27, 2010

(30) Foreign Application Priority Data

Nov. 21, 2008 (JP) ..... 2008-298178

(51) Int. Cl.
*G09G 5/02* (2006.01)

(52) U.S. Cl.
USPC ..... 345/589

(58) Field of Classification Search
None
See application file for complete search history.

(56) References Cited

U.S. PATENT DOCUMENTS

| | | | | |
|---|---|---|---|---|
| 7,389,432 | B2 * | 6/2008 | Chandley et al. | 713/320 |
| 7,499,043 | B2 * | 3/2009 | Vasqnez et al. | 345/212 |
| 2002/0024496 | A1 | 2/2002 | Akimoto | |
| 2003/0197790 | A1 * | 10/2003 | Bae | 348/211.99 |
| 2004/0252115 | A1 * | 12/2004 | Boireau | 345/211 |
| 2008/0100598 | A1 * | 5/2008 | Juenger | 345/204 |
| 2008/0143728 | A1 * | 6/2008 | Gorla et al. | 345/501 |
| 2009/0109159 | A1 * | 4/2009 | Tsai | 345/98 |
| 2009/0153591 | A1 * | 6/2009 | Shin et al. | 345/690 |

FOREIGN PATENT DOCUMENTS

| | | |
|---|---|---|
| CN | 101295496 A | 10/2008 |
| JP | 2001-042831 A | 2/2001 |

* cited by examiner

*Primary Examiner* — Edward Martello
(74) *Attorney, Agent, or Firm* — Canon U.S.A., Inc., IP Division

(57) ABSTRACT

A display control apparatus controlling luminous intensity in a display screen so that luminous intensity of the display screen displayed at a first frame rate is higher than luminous intensity of the display screen displayed at a second frame rate that is higher than the first frame rate. The display control apparatus identifies pixels showing luminosity higher than a predetermined value in the image, and depending on location of the pixels showing luminosity higher than the predetermined value, the display control apparatus determines a region displayed at the first frame rate and a region displayed at the second frame rate.

14 Claims, 11 Drawing Sheets

DISPLAY CONTROL APPARATUS AND DISPLAY CONTROL METHOD THAT DETERMINES A PLURALITY OF REGIONS IN A FRAME TO BE DISPLAYED AT DIFFERENT FRAME RATES THAN ONE ANOTHER

BACKGROUND OF THE INVENTION

1. Field of the Invention

The present invention relates to a display control apparatus and display control method that can change a driving frequency (frame rate).

2. Description of the Related Art

A technique is known in which the frame rate (60 Hz) of broadcast waves is changed to the display driving frequency (120 Hz or 240 Hz) in a double-speed drive system. For example, Japanese Patent Application Laid-Open No. 2001-42831 discusses increasing the frame rate of a display image to be higher than the frame rate of an input image signal to improve quality of the display image.

However, if the frame rate is increased, a region that needs to be brightly displayed may be perceived to be dark in the display image.

For example, even when a luminous intensity per unit time is maintained at a certain level, if the luminous frequency of a display screen is changed, brightness of the display screen may be perceived differently. One of the causes for this phenomenon is that humans' perceptual sensitivity to brightness differs depending on the luminous frequency. Thus, for example, when the frame rate of an input image signal is 60 Hz, if the output frame rate (driving frequency) is changed to 120 Hz, the image may be perceived to be more dark, compared with the image displayed at 60 Hz.

Thus, for example, when a display image includes a region that needs to be displayed brightly (such as a starry sky or a firework), if the frame rate is increased and the image is thus displayed darkly, observers may perceive that the image quality has been deteriorated.

SUMMARY OF THE INVENTION

The present invention is directed to preventing regions that need to be brightly displayed from being perceived to be dark.

According to an aspect of the present invention, the display control apparatus comprises the following units. The present invention provides a display control apparatus controlling luminous intensity in a display screen so that luminous intensity of the display screen, in which an image based on an input image signal is displayed at a first frame rate, becomes higher than a luminous intensity of a display screen in which the image based on the input image signal is displayed at a second frame rate that is higher than the first frame rate. The display control apparatus comprises an identification unit configured to identify pixels showing luminosity higher than a predetermined value within an image based on an input image signal, and a determination unit configured to determine a region displayed at a first frame rate and a region displayed at a second frame rate, depending on location of the pixels showing luminosity higher than the predetermined value.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
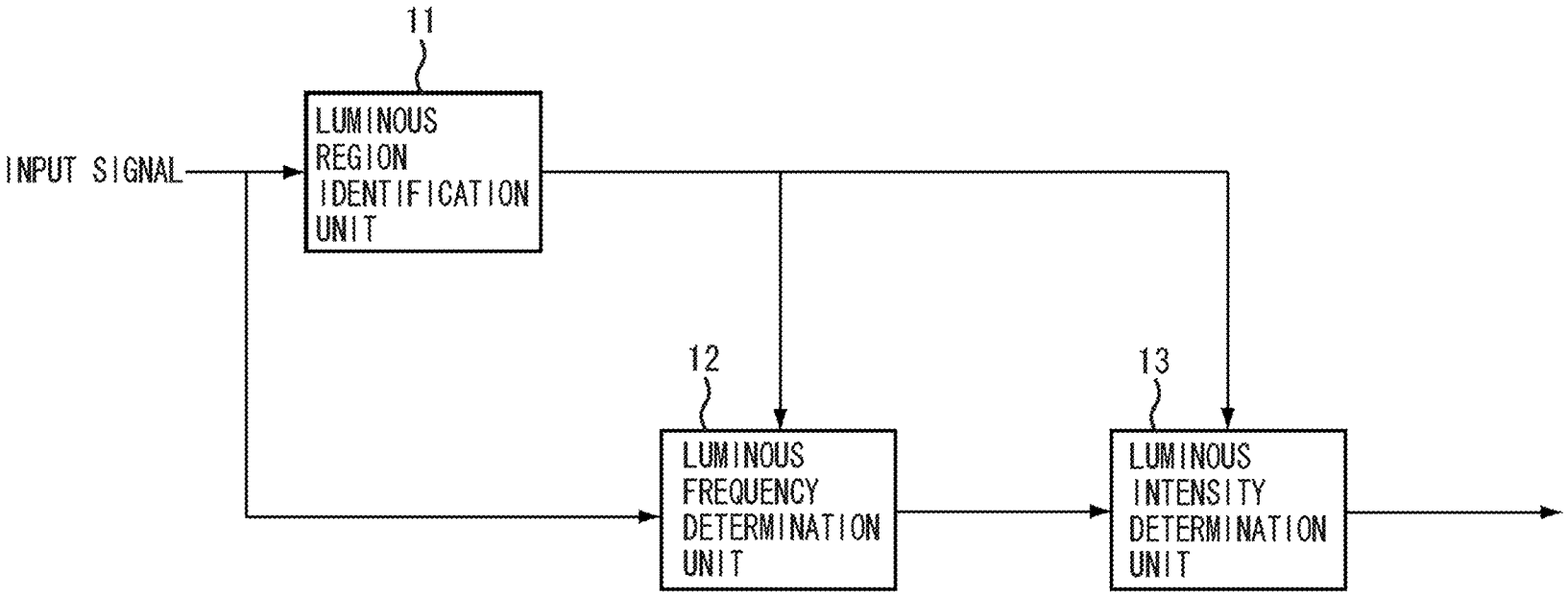
FIG. 1 is a block diagram illustrating an example of the structure of a display control apparatus according to a first exemplary embodiment of the present invention.

FIG. 1 is a block diagram illustrating an example of the structure of a display control apparatus according to a first exemplary embodiment. As shown in FIG. 1, the display control apparatus of the present exemplary embodiment comprises a luminous region identification unit 11, a luminous frequency determination unit 12, and a luminous intensity determination unit 13.

The display control apparatus of the present exemplary embodiment may be incorporated in an image input apparatus to which an input image signal is input or in a display device displaying images or moving images. Alternately, the display control apparatus may also be incorporated in the apparatus other than the above-described apparatus.

An image input apparatus (not shown) supplies an input image signal to the luminous region identification unit 11, and based on the image according to the supplied input image signal, the luminous region identification unit 11 identifies a luminous region. In the present exemplary embodiment, the luminous region is a region that needs to be displayed more brightly than the other region (non-luminous region) in the display image. Within the image displayed based on the input image signal, such luminous region is identified based on the location of pixels showing luminosity higher than a predetermined value. Namely, the luminous region identification unit 11 identifies pixels showing luminosity higher than a predetermined value in the image displayed based on an input image signal. The method for determining the luminous region with the luminous region identification unit 11 will be described with reference to FIG. 5 below. The luminous region identification unit 11 outputs region information for identifying the luminous region to the luminous frequency determination unit 12 and the luminous intensity determination unit 13.

The luminous frequency determination unit 12 is provided with the input image signal from the image input apparatus (not shown) and with the region information for identifying the luminous region from the luminous region identification unit 11. The luminous frequency determination unit 12 changes driving frequencies, so that a driving frequency (frame rate) of the luminous region becomes lower than a driving frequency of the other region (non-luminous regions). For example, the luminous frequency determination unit 12 changes driving frequencies, so that the driving frequency of the luminous region becomes 60 Hz and the driving frequency of the other area (non-luminous region) becomes 120 Hz. The frame rate of the input image signal is 60 Hz, for example.

Namely, the luminous frequency determination unit 12 determines a region that needs to be displayed at a first frame rate (60 Hz, for example) and a region that needs to be displayed at a second frame rate (120 Hz, for example), depending on the location of pixels showing luminosity higher than a predetermined value. The driving frequency (frame rate) corresponds to the luminous frequency of a display screen. The luminous frequency determination unit 12 outputs the changed driving frequency to the luminous intensity determination unit 13.

The luminous intensity determination unit 13 acquires information concerning the changed driving frequency and the region information for identifying the luminous region. The luminous intensity determination unit 13 determines luminous intensity based on changes in driving frequency. For example, when the luminous frequency determination unit 12 decreases the driving frequency of a luminous region, the luminous intensity determination unit 13 determines the luminous intensity of the luminous region so that a single luminous intensity of the luminous region is increased.

More specifically, the luminous intensity determination unit 13 increases the luminous intensity of a display screen which displays an image based on an input image signal at the first frame rate, to be higher than the intensity of a display screen which displays the image at the second frame rate, which is higher than the first frame rate. The operation for changing the luminous intensity by the luminous intensity determination unit 13 will be described in detail below.

Figure 2:
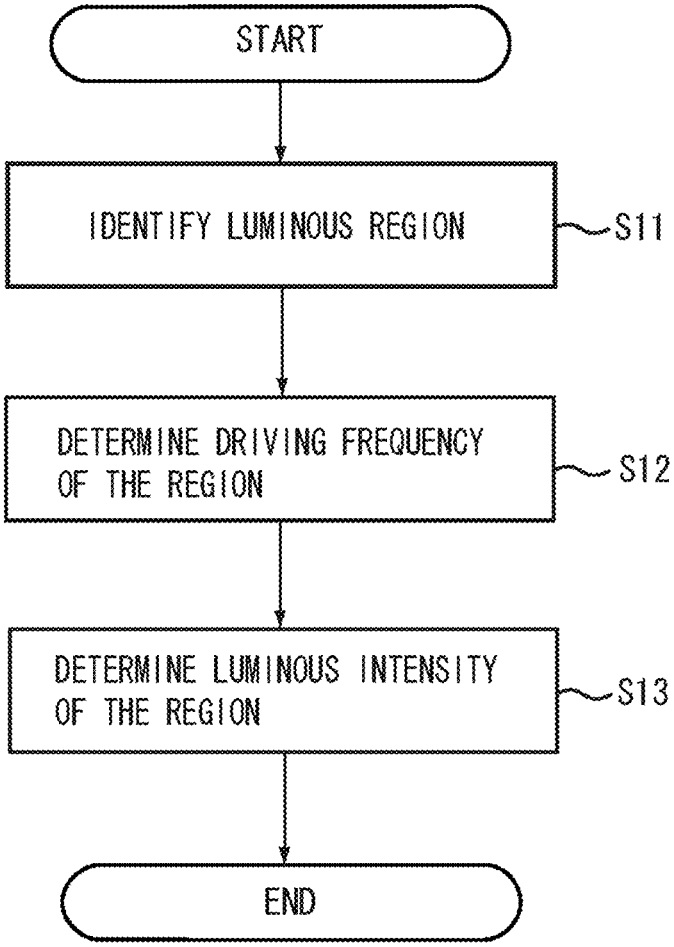
FIG. 2 is a flow chart illustrating an operation according to the first exemplary embodiment of the present invention.

FIG. 2 is a flow chart illustrating an operation for identifying a luminous region and controlling a driving frequency executed by the display control apparatus of the present exemplary embodiment.

First, the luminous region identification unit 11 identifies a luminous region in an image displayed based on an input image signal (S11). The luminous region is a region that needs to be displayed more brightly than the other region (non-luminous regions) in the display image. In the image displayed based on the input image signal, the luminous region is identified based on the location of pixels showing luminosity higher than a predetermined value. Namely, in step S11, the luminous region identification unit 11 identifies pixels showing luminosity higher than a predetermined value in an image displayed based on an input image signal. Details of the determination of the luminous region will be described with reference to FIG. 5 below. The luminous region identification unit 11 outputs the region information (coordinate information) for identifying the luminous region to the luminous frequency determination unit 12 and the luminous intensity determination unit 13.

Next, the luminous frequency determination unit 12 determines the driving frequency of the luminous region based on the region information for identifying the luminous region (S12). The driving frequency is determined based on human visual characteristics. For example, the luminous frequency determination unit 12 determines the driving frequency of the luminous region to be 60 Hz because based on visual characteristics, human beings perceive a screen displayed at a driving frequency of 60 Hz to be brighter than a screen displayed at a driving frequency of 120 Hz. Further, the luminous frequency determination unit 12 determines the driving frequency of the non-luminous region to be 120 Hz. More specifically, in step S12, the luminous frequency determination unit 12 determines a region that needs to be displayed at the first frame rate (60 Hz, for example) and a region that needs to be displayed at the second frame rate (120 Hz, for example), depending on the location of pixels showing luminosity higher than a predetermined value. As the human visual characteristics, publicly-known characteristics may be used. Alternatively, for example, users may observe and evaluate test images, and the thus acquired visual characteristics may be used. The luminous frequency determination unit 12 outputs the changed driving frequency to the luminous intensity determination unit 13.

Next, the luminous intensity determination unit 13 acquires the driving frequency output from the luminous frequency determination unit 12 and the region information for identifying the luminous region output from the luminous region identification unit 11. Subsequently, the luminous intensity determination unit 13 determines the luminous intensity of the display screen (S13). In other words, the luminous intensity determination unit 13 determines the luminous intensity of each of the luminous region and the non-luminous region. The method for determining the luminous intensity will be hereinafter described.

First, a method for equalizing the driving power per unit time between before and after the driving frequency is changed will be described. Assuming that the driving frequency before the driving frequency is changed is f [Hz] and a single luminous intensity before the luminous intensity is changed is I, a luminous intensity P per second can be represented by the following mathematical formula:

$$P=f\times I \tag{1}$$

The luminous intensity P is a value corresponding to the driving power per second per pixel of the display device, and the luminous intensity P is different from brightness perceived by humans.

Next, assuming that the driving frequency after the driving frequency is changed is f' [Hz] and a single luminous intensity per pixel after the luminous intensity is changed is I', a luminous intensity P' per second can be represented by the following mathematical formula:

$$P'=f'\times I' \tag{2}$$

To maintain the driving power of the region in which the driving frequency is changed, at the same level, the relationship P=P' needs to be established. Thus, the single luminous intensity I' after the driving frequency is changed can be determined by the following mathematical formula:

$$I'=I\times f/f' \tag{3}$$

When I' shown in the above formula (3) is taken as single luminous intensity of the region (luminous region) in which the driving frequency is changed, the driving power can be maintained at the same level between before and after the driving frequency is changed. As shown in the formula (3), if the driving frequency is decreased while maintaining the driving power at the same level, a single luminous intensity increases. For example, if the driving frequency is decreased from 120 Hz to 60 Hz, a single luminous intensity I' after the change of the driving frequency, becomes twice the luminous intensity I before the change of the driving frequency. When the driving power is the same, observers perceive an image displayed at a driving frequency of 60 Hz to be brighter than the image displayed at a driving frequency of 120 Hz. Thus, the luminous region after the driving frequency is changed can be perceived to be brighter than the luminous region before the driving frequency is changed.

Other methods for determining the luminous intensity may be used. For example, the luminous intensity may be determined based on an amount of human perceptual sensitivity to brightness. First, the perceptual sensitivity to brightness for each driving frequency (luminous frequency) is defined to be a perception coefficient k(f). The luminous frequency f (Hz) and the perception coefficient k(f) dependent on the luminous frequency f are used. The greater the perception coefficient k(f), the brighter an image is perceived.

Figure 3:
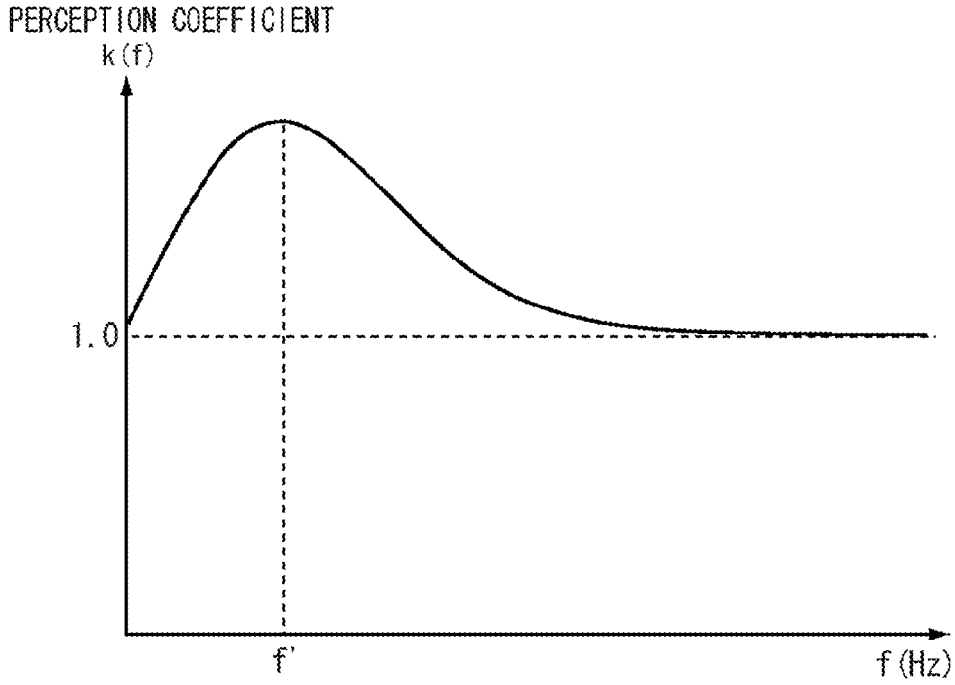
FIG. 3 illustrates an example of the perception coefficient according to the first exemplary embodiment of the present invention.
Figure 4:
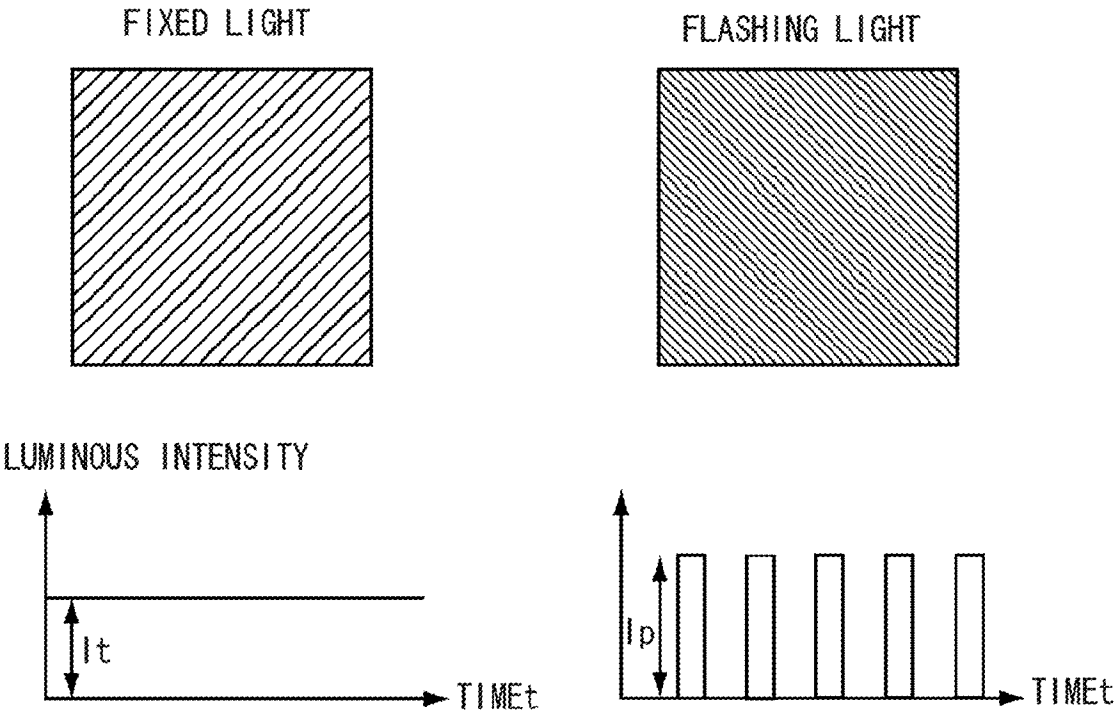
FIG. 4 illustrates an example of the subjective evaluation test for calculating the perception coefficient according to the first exemplary embodiment of the present invention.

FIG. 3 shows an example of the perception coefficient k(f). As shown in FIG. 3, the perception coefficient k(f) reaches its maximum level at a luminous frequency f'. Namely, the figure shows that a screen is perceived to be the brightest when the luminous frequency is f'. This perception coefficient can be determined, for example, as shown in FIG. 4, by examining the luminous intensity of a fixed light which is perceived to have the brightness equal to a flashing light, for each luminous frequency. For example, the luminous intensity of a fixed light perceived to have the brightness equal to a flashing light at a luminous frequency (driving frequency) of 60 Hz is examined. Further, for example, the luminous intensity of a fixed light perceived to have the brightness equal to a flashing light at a luminous frequency of 120 Hz is examined. The driving power of the screen displaying the 60 Hz and 120 Hz flashing light is the same. Thus, by allowing a user to select a fixed light perceived to have the brightness equal to a flashing light for each luminous frequency, the perception coefficient can be obtained.

An average value of a plurality of subjective evaluation tests may be used as the perception coefficient. Alternatively, the perception coefficient may be set per observer.

Assuming that the luminous frequency (driving frequency) before the change of the frequency is f [Hz] for the perception coefficient k(f) and a single luminous intensity before the change of the frequency is I, an amount of perceptual sensitivity to brightness per second B can be represented by the following mathematical formula:

$$B=f\times I\times k(f) \tag{4}$$

Next, assuming that the luminous frequency (driving frequency) after the change of the frequency is f' [Hz] and a single luminous intensity after the change of the frequency is I', an amount of perceptual sensitivity to brightness per second B' can be represented by the following mathematical formula:

$$B'=f'\times I'\times k(f') \tag{5}$$

To equalize the amount of perceptual sensitivity to brightness between before and after the luminous frequency is changed, the relationship B=B' needs to be established. Thus, the single luminous intensity I' after the frequency is changed can be represented by the following mathematical formula:

$$I'=k(f)\times f\times I/(k(f')\times f') \tag{6}$$

Assuming that the luminous intensity per second based on the single luminous intensity I' shown in the mathematical formula (6) is P", the following mathematical formula can be obtained:

$$P''=I'\times f'=k(f)\times I\times f/k(f') \tag{7}$$

Based on the mathematical formula (I), the luminous intensity P" can also be represented as follows:

$$P''=k(f)\times P/k(f') \tag{8}$$

Further, assuming that the amount of human perceptual sensitivity to brightness is higher at the luminous frequency f' than at the luminous frequency f, the following relationship is established.

$$k(f)<k(f') \tag{9}$$

Accordingly, the following relationship is established.

$$k(f)/k(f')<1 \tag{10}$$

In view of the above formula (8) and relationship (10), the luminous intensity P" per second after the luminous frequency is changed is smaller than the luminous intensity P before the luminous frequency is changed. Further, for example, when the driving frequency (luminous frequency) of the entire screen is 120 Hz, if the driving frequency of a luminous region identified in a certain frame is changed to 60 Hz, the relationship between the luminous intensity and brightness is as follows, assuming that when the luminous frequency is 60 Hz, the perception coefficient K(60) is 1.5, and when the luminous frequency is 120 Hz, the perception coefficient K(120) is 1.2. According to the formula (8), if the luminous intensity P" per second of the luminous region is 4/5 of the luminous intensity P per second before the driving frequency is changed, the perceived brightness of the screen does not change between before and after the driving frequency is changed. Thus, if the single luminous intensity is 8/5 (1.6 times) of the luminous intensity before the driving frequency is changed, while the luminous intensity per second is 0.8 times, the perceived brightness of the screen does not change.

Further, when the driving frequency is decreased by half, if the single luminous intensity is doubled, the driving power can be maintained at the same level. More specifically, when the driving frequency is changed from 120 Hz to 60 Hz, if the single luminous intensity is in a range between higher than 1.6 times and lower than twice the luminous intensity before the driving frequency is changed, the luminous region can be perceived to be more bright than the luminous region before the driving frequency is changed, and the driving power can also be decreased.

Thus, when the driving frequency of a luminous region is changed, the range of the luminous intensity after the change, can be calculated based on the perception coefficient. Further, by changing the luminous intensity of the luminous region based on the calculated range, the luminous region can be perceived to be bright and the driving power can be suppressed. The value of the luminous intensity within the calculated range can be determined based on settings made by users in advance. More specifically, users can set the balance between brightness of the luminous region and the driving power in advance. In this way, an image that further suits to users' preferences can be displayed.

Figure 5:
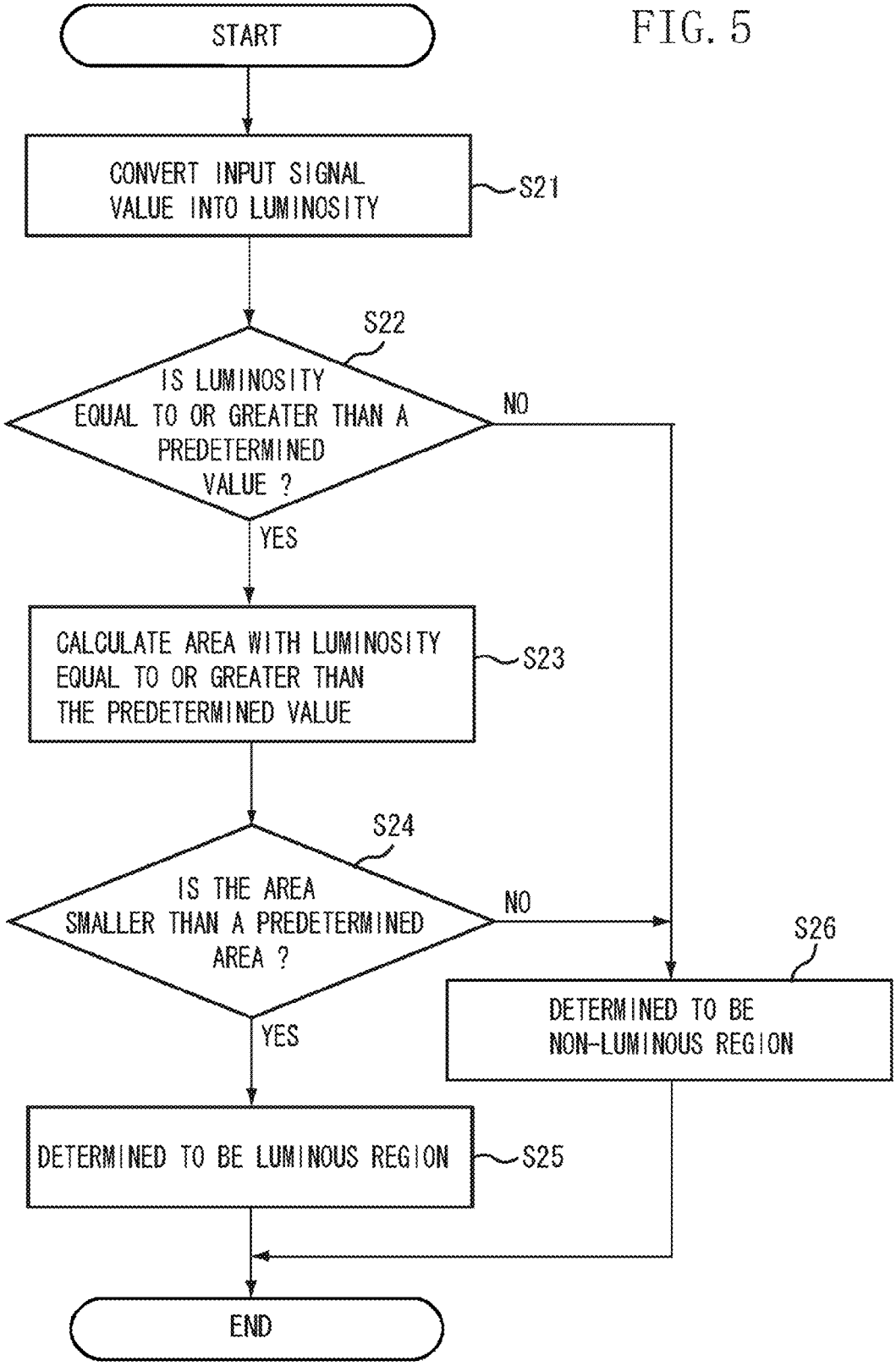
FIG. 5 is a flow chart illustrating an operation of a luminous region identification unit.

Next, an operation of the luminous region identification unit 11 for identifying a luminous region will be described with reference to FIG. 5.

First, the luminous region identification unit 11 converts an RGB value of an input image signal into color information and acquires a luminosity component (S21). Examples of the color information include XYZ and L*a*b*. The luminous region identification unit 11 of the present exemplary embodiment converts the RGB value of an input image signal into L*a*b* and acquires a luminosity component L*. While the luminous region identification unit 11 of the present exemplary embodiment converts the RGB value into color information per frame, the conversion may be carried out based on a plurality of frames or blocks within a frame.

Next, in step S22, the luminous region identification unit 11 examines each pixel in an image displayed based on the input image signal and identifies pixels with a value of the luminosity component L* equal to or greater than a predetermined threshold value. Namely, the luminous region identification unit 11 identifies pixels with luminosity greater than a predetermined value in an image displayed based on the input image signal. The luminous region identification unit 11 of the present exemplary embodiment sets the luminosity 20% below an upper limit as the threshold value. Namely, the luminous region identification unit 11 identifies pixels with luminosity in a range between an upper limit and 20% below the upper limit. However, the threshold value is not limited to such range. For example, depending on the scene of an image to be displayed, the threshold value may be changed.

Next, in step S23, the luminous region identification unit 11 acquires the area of a region in which pixels with a value of the luminosity component L* higher than the threshold value are adjacent to each other. Namely, the luminous region identification unit 11 acquires the area of a region in which pixels with a value of the luminosity component L* higher than the threshold value are not divided by pixels with a value of the luminosity component L* lower than the threshold value but are consecutively adjacent to each other. When the display screen includes a plurality of regions with a value of luminosity component L* higher than the threshold value, the luminous region identification unit 11 acquires the area of each region.

Next, in step S24, the luminous region identification unit 11 compares the acquired area with a predetermined area. If the acquired area is smaller than the predetermined area (Yes in step S24), the luminous region identification unit 11 of the present exemplary embodiment identifies the region as a luminous region in step S25. Namely, with respect to the pixels showing luminosity higher than a predetermined value, when the number of pixels adjacent to each other is less than a predetermined number of pixels, the luminous region identification unit 11 identifies the region as a luminous region. The predetermined number of pixels may be set, for example, approximately below 1/50 of the area of the entire display screen.

If the acquired area is larger than the predetermined area (No in step S24), the luminous region identification unit 11 identifies the region as a non-luminous region in step S26. When the display screen includes a plurality of regions with a value of the luminosity component L* higher than the threshold value, the luminous region identification unit 11 compares the acquired area and the predetermined area for each region and identifies a luminous region and a non-luminous region according to the comparison results.

In the above description, when the area of a region with a value of the luminosity component L* higher than a threshold value is smaller than a predetermined area, the region is determined to be a luminous region. This is because, for example, an image displaying a night view, a firework, a starry sky, or the like often has a dark background, and regions that need to be displayed brightly are scattered around in the image. Thus, when the area of a region with a high value of the luminosity component L* is small, the luminous region identification unit 11 of the present exemplary embodiment identifies the region as a region that needs to be displayed brightly. However, depending on the scene to be displayed, even when the area of a region with a high luminosity component is large, the luminous region identification unit 11 may determine the region as a luminous region.

Further, in step S26, the luminous region identification unit 11 determines the region of pixels with a value of the luminosity component L* lower than a threshold value as a non-luminous region.

As described above, based on the display control apparatus of the present exemplary embodiment, the luminous region identification unit 11 identifies a region (luminous region) that needs to be displayed brightly in the image displayed based on an input image signal. The luminous frequency determination unit 12 controls driving frequencies, so that the driving frequency of the luminous region becomes lower than the driving frequency of the other region (non-luminous region).

In this way, the region that needs to be displayed brightly is prevented from being perceived as dark.

Next, a second exemplary embodiment of the present invention will be described, focusing on the differences from the first exemplary embodiment.

Figure 6:
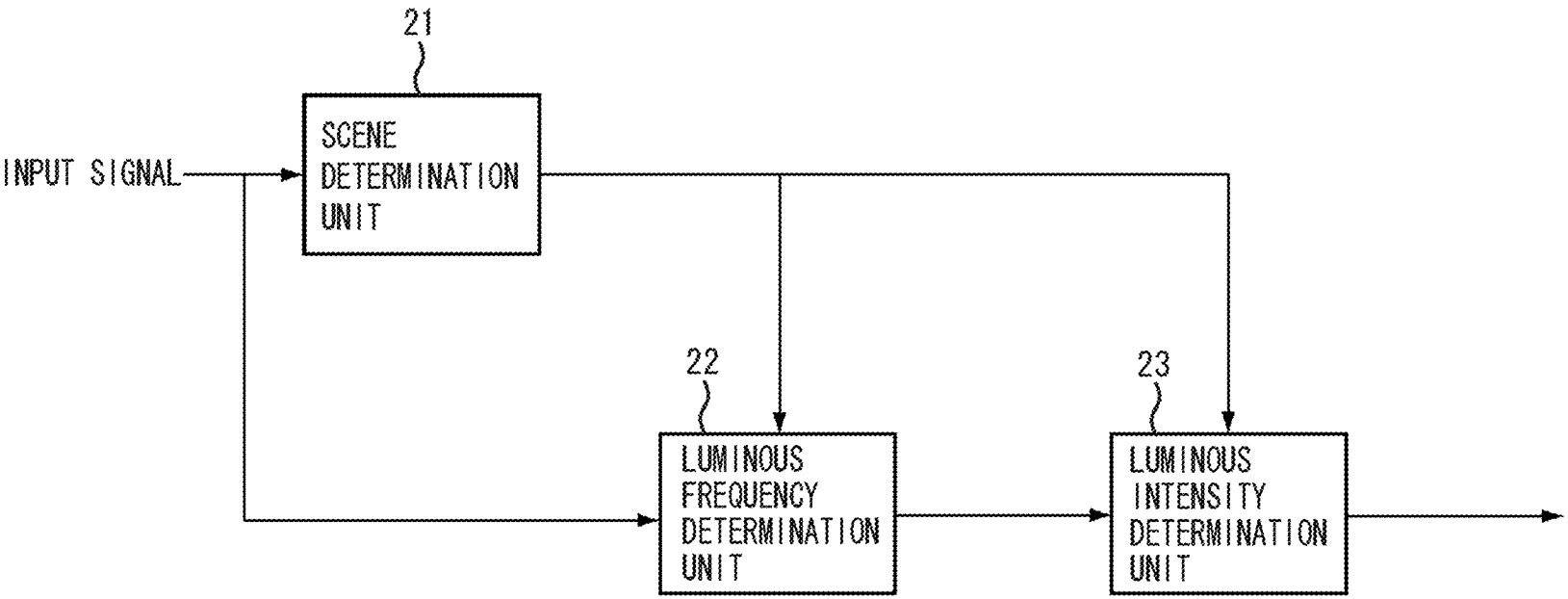
FIG. 6 is a block diagram illustrating an example of the structure of a display control apparatus according to a second exemplary embodiment of the present invention.

FIG. 6 is a block diagram illustrating an example of the structure of a display control apparatus according to the present exemplary embodiment. As shown in the figure, the display control apparatus of the present exemplary embodiment comprises a scene determination unit 21, a luminous frequency determination unit 22, and a luminous intensity determination unit 23.

The scene determination unit 21 determines the scene of an image displayed on a display device. For example, the scene determination unit 21 determines whether a currently displayed image is a scene of a night view, a firework, a starry sky, or the like. Characteristics of such scene are that the background is dark and a region that needs to be brightly displayed is included. Thus, the scene determination unit 21 of the present exemplary embodiment determines whether the display device displays a scene in which a large portion of the image is dark.

Figure 7:
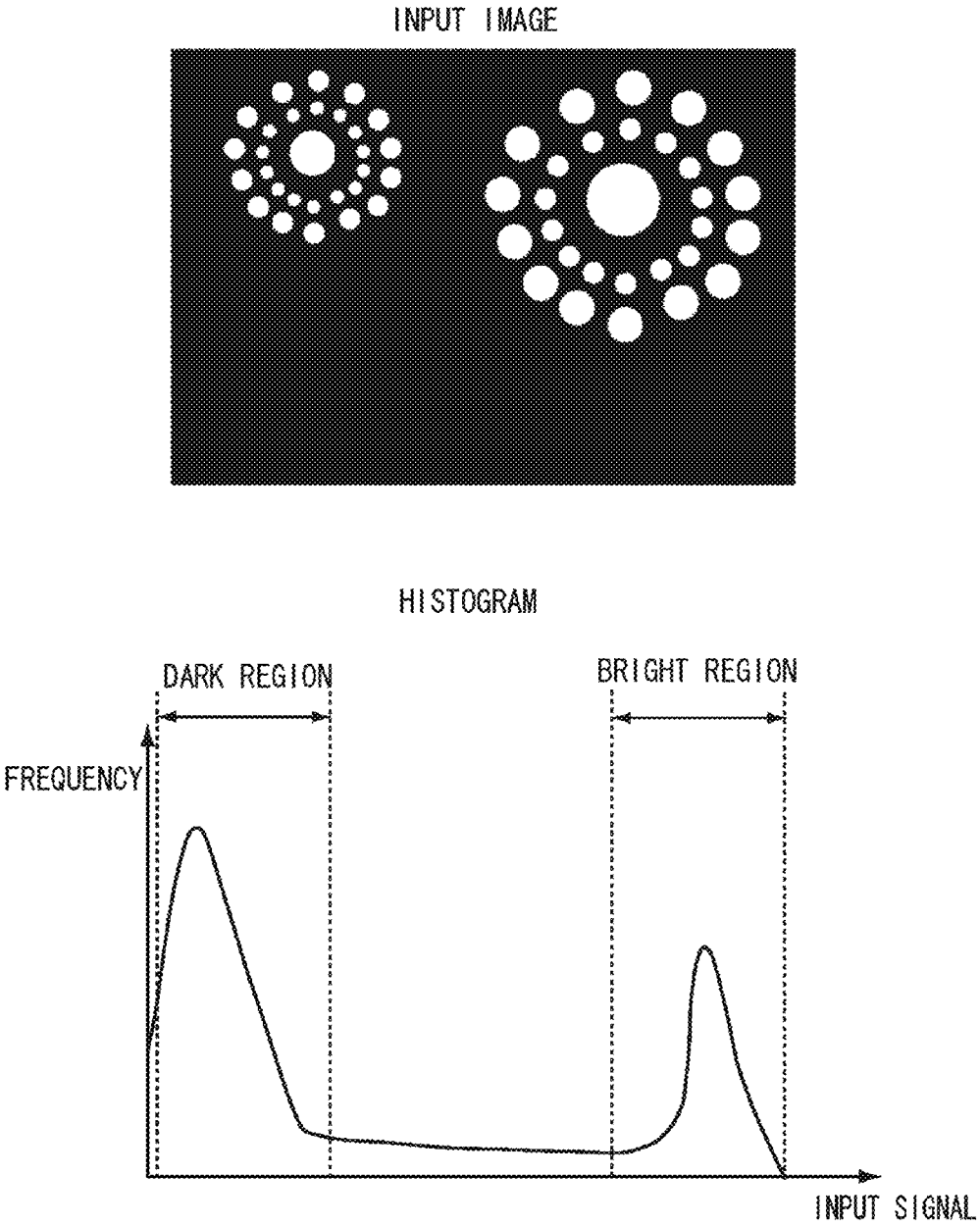
FIG. 7 illustrates an example of an image to be determined by a scene determination unit and a histogram of the image.

An example of the method for determining a scene with the scene determination unit 21 will be described. First, the scene determination unit 21 obtains a histogram of a single frame of an image displayed based on an input image signal, and based on the shape of the histogram, the scene determination unit 21 determines whether the frame is a scene of a night view, a firework, or the like. FIG. 7 shows an example of the histogram. In the histogram of an image including bright and dark regions, such as a night view or a firework, the frequency is high in the dark and bright regions. Thus, the scene determination unit 21 obtains the histogram of a single frame from an input image signal, and based on the histogram, the scene determination unit 21 acquires the number of pixels in the bright region and the number of pixels in the dark region. More specifically, the scene determination unit 21 determines pixels showing luminosity equal to or greater than a first value and pixels showing luminosity equal to or less than a second value which is lower than the first value, within an image displayed based on an input image signal. The pixels showing luminosity equal to or greater than the first value belong to the bright region in FIG. 7, and the pixels showing luminosity equal to or less than the second value belong to the dark region in FIG. 7.

In the present exemplary embodiment, when the number of pixels belonging to the dark region is large, the scene determination unit 21 determines that the frame is a scene displaying an image including a dark background, such as a night view or a firework. This determination may be made per frame, or regularly, or upon detection of change of a scene. Further, for example, as a scene determination method other than the one that uses a histogram, an average value or a median value of the luminosity component L* of an image displayed based on an input image signal may be used. Namely, the scene determination unit 21 may be configured to determine an image to be a scene of a firework, a night view, or the like, when the average value of the luminosity component L* of an image displayed based on an input image signal is lower than a predetermined value.

When the scene determination unit 21 determines that an image to be displayed is a scene including a dark background, the scene determination unit 21 identifies a luminous region in the image. The method for determining the luminous region is similar to that used by the luminous region identification unit 11 of the first exemplary embodiment. The scene determination unit 21 outputs region information for identifying the luminous region to the luminous frequency determination unit 22 and the luminous intensity determination unit 23.

Like the luminous frequency determination unit 12 and the luminous intensity determination unit 13 of the first exemplary embodiment, the luminous frequency determination unit 22 and the luminous intensity determination unit 23 control the driving frequency and the luminous intensity of the luminous region, respectively, based on the region information for identifying the luminous region.

Namely, when the number of pixels showing luminosity equal to or less than the second value is equal to or greater than a predetermined value, depending on the location of the pixels showing luminosity equal to or greater than the first value, the luminous frequency determination unit 22 determines a region to be displayed at a first frame rate and a region to be displayed at a second frame rate. Namely, when the number of pixels belonging to the dark region of the histogram shown in FIG. 7 is equal to or greater than a predetermined number, the luminous frequency determination unit 22 determines the frame rates so that the frame rate of the luminous region becomes lower than the frame rate of the non-luminous region. In this way, when displaying an image having a large dark portion, the region that needs to be brightly displayed can be more brightly displayed.

As described above, when a large portion of the displayed image is a dark region, the display control apparatus of the present exemplary embodiment controls the driving frequency and the luminous intensity so that the luminous region is perceived to be bright. In this way, a region that needs to be brightly displayed (luminous region) can be more brightly displayed.

When a display image includes a dark background and a region that needs to be brightly displayed (luminous region), the scene determination unit 21 of the present exemplary embodiment determines the driving frequency and the luminous intensity for each of the luminous region and the non-luminous region. However, the present invention is not limited to such example. For example, when an image includes a dark background and a region that needs to be brightly displayed, the driving frequency of the entire image may be decreased. In this way, the luminous region can also be perceived to be bright. Also, the scene determination unit 21 may be configured to decrease the driving frequency, when a large portion of an image to be displayed is a region that needs to be brightly displayed. In this way, a region that needs to be brightly displayed can also be more brightly displayed.

Next, a third exemplary embodiment of the present invention will be described, focusing on the differences from the first exemplary embodiment.

Figure 8:
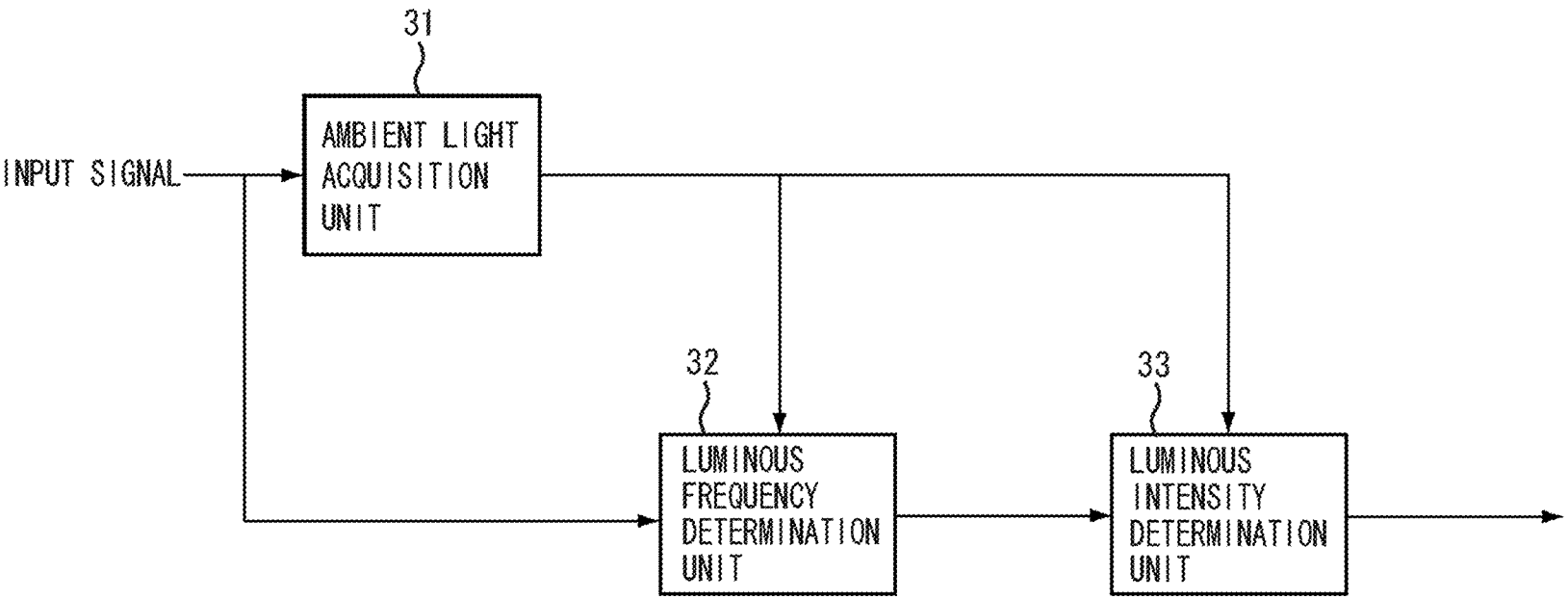
FIG. 8 is a block diagram illustrating an example of the structure of a display control apparatus according to a third exemplary embodiment of the present invention.

FIG. 8 is a block diagram illustrating an example structure of a display control apparatus of the third exemplary embodiment. As shown in the figure, the display control apparatus of the present exemplary embodiment comprises an ambient light acquisition unit 31, a luminous frequency determination unit 32, and a luminous intensity determination unit 33.

The ambient light acquisition unit 31 acquires brightness of the environment in which the display device is placed. Namely, the ambient light acquisition unit 31 acquires ambient brightness of the display device displaying an image formed based on an input image signal. The ambient light acquisition unit 31 determines whether the acquired brightness is below a threshold value. For example, the ambient light acquisition unit 31 acquires illuminance of a room with an illuminance sensor to determine whether the illuminance of the room is equal to or less than a threshold value.

Further, the ambient light acquisition unit 31 identifies the luminous region of an image displayed based on an input image signal, similar to the luminous region identification unit 11 of the first exemplary embodiment. The ambient light acquisition unit 31 outputs region information for identifying the luminous region and information concerning the ambient brightness to the luminous frequency determination unit 32 and the luminous intensity determination unit 33. Depending on the ambient brightness, the luminous frequency determination unit 32 and the luminous intensity determination unit 33 determine the driving frequency and the luminous intensity for the luminous region and the non-luminous region.

For example, when the ambient brightness is determined to be lower than a predetermined brightness, the luminous frequency determination unit 32 determines the luminous frequency so that the driving frequency of the luminous region becomes lower, compared with the driving frequency of the luminous region when the ambient brightness is higher than the predetermined brightness. More specifically, when the ambient light shows a first brightness, the luminous frequency determination unit 32 displays, at a frame rate lower than the first frame rate, a region (luminous region) to be displayed at a first frame rate in a case where the ambient brightness shows a second brightness which is greater than the first brightness. The luminous intensity determination unit 33 determines the luminous intensity in a way similar to that described in the first exemplary embodiment.

In this way, for example, when displaying a luminous region at a driving frequency of 120 Hz and a non-luminous region at a driving frequency of 240 Hz, if the brightness around the display device is low, by decreasing the driving frequency of the luminous region to 60 Hz, the luminous region can be displayed more brightly.

Thus, when the display device is placed in a dark environment, the driving frequency and the luminous intensity are changed so that the luminous region is perceived to be bright. This is because humans' sensitivity to brightness increases in a dark environment. For example, when the display device is placed in a dark room, the observer probably wishes to have a luminous region displayed more brightly. Thus, when the display device is placed in a dark environment, the display control apparatus of the present exemplary embodiment controls the luminous region to be more brightly perceived. In the present exemplary embodiment, the luminous region is controlled to be brightly perceived. In this way, the luminous region can be perceived to be brighter. However, when the display device is placed in a dark environment, the driving frequency of the entire image may be decreased so that the entire image is brightly displayed.

In the above example, the driving frequency is changed in stages depending on the ambient brightness. However, for example, identification of the luminous region and change of the driving frequency may be carried out when the ambient brightness is determined to be lower than a predetermined brightness. In this way, the region that needs to be brightly displayed can be brightly displayed in a less calculation amount.

Additionally, for example, when the display device is placed in a bright environment, the driving frequency and the luminous intensity may be controlled so that the luminous region is brightly displayed. This is because, since humans' sensitivity to brightness decreases in a bright environment, the observer perceives the display image to be dark. Thus, when the environment in which the display device is placed is brighter than a predetermined brightness, the driving frequency and the luminous intensity are determined so that the luminous region is perceived to be brighter. Thus, the region that needs to be brightly displayed can be more brightly displayed.

Further, users can set in advance whether to perform control to display more brightly a region (luminous region) that needs to be brightly displayed. Thus, an image that further suits to users' preferences can be displayed.

Next, a fourth exemplary embodiment of the present invention will be described, focusing on the difference from the first exemplary embodiment.

Figure 9:
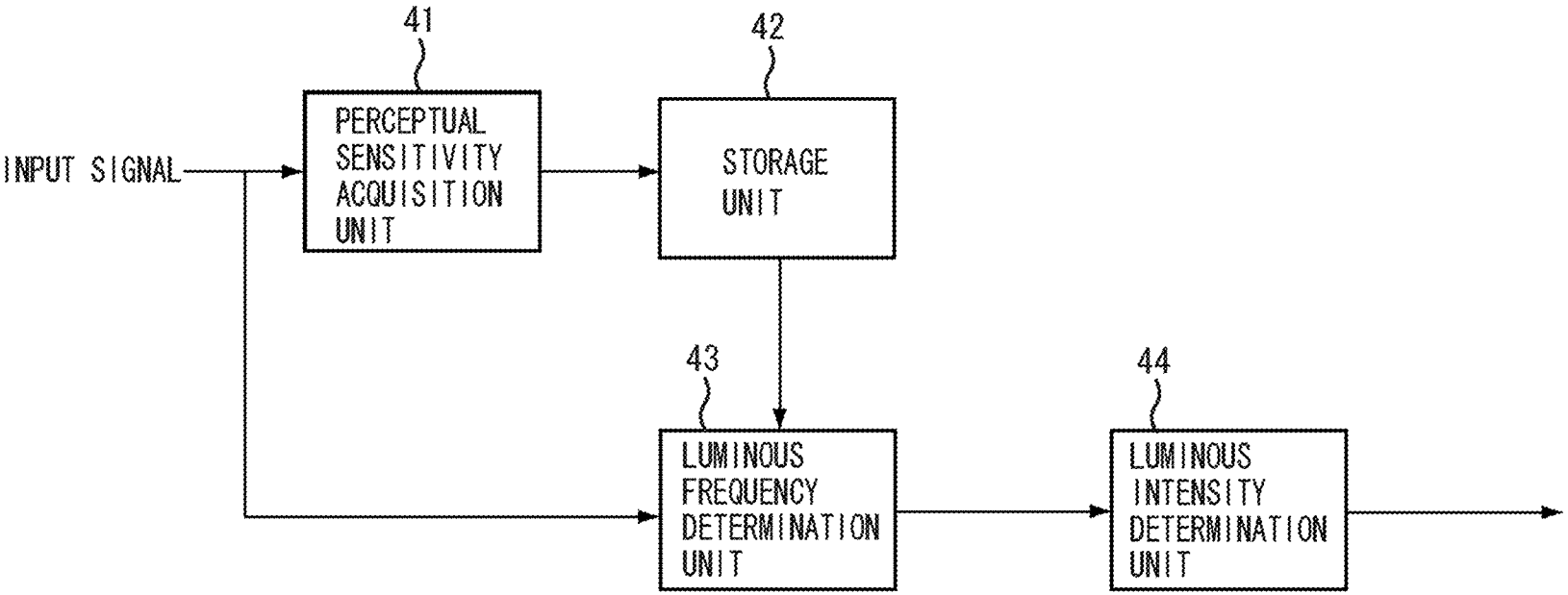
FIG. 9 is a block diagram illustrating an example of the structure of a display control apparatus according to a fourth exemplary embodiment of the present invention.

FIG. 9 is a block diagram illustrating an example of the structure of a display control apparatus of the present exemplary embodiment. As shown in the figure, the display control apparatus of the present exemplary embodiment comprises a perceptual sensitivity acquisition unit 41, a storage unit 42, a luminous frequency determination unit 43, and a luminous intensity determination unit 44.

The perceptual sensitivity acquisition unit 41 acquires information concerning users' perceptual sensitivity to brightness with respect to the luminous frequency. More specifically, the perceptual sensitivity acquisition unit 41 acquires perceptual sensitivity information indicating which luminous frequency provides a display screen which is perceived to be bright by each user.

Figure 10:
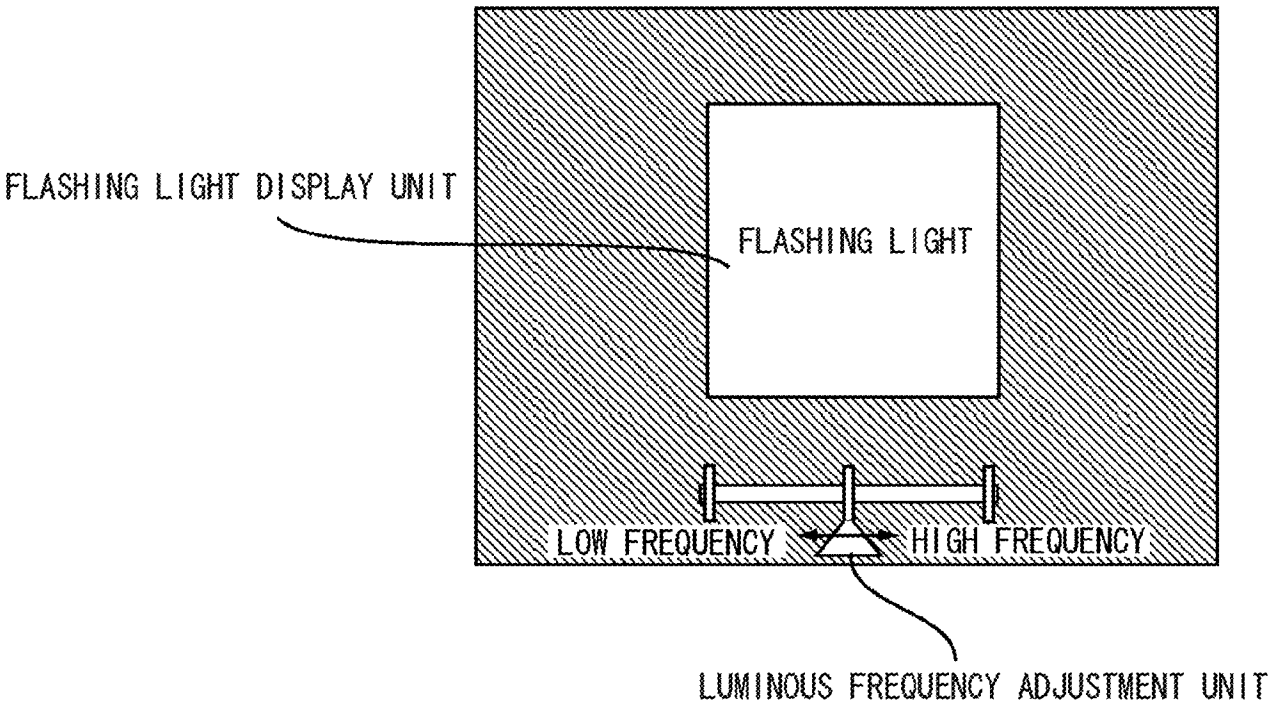
FIG. 10 illustrates an example of the display screen for acquiring observers' perceptual sensitivity to brightness.

An example of the method for acquiring the users' perceptual sensitivity to brightness will be hereinafter described. First, the perceptual sensitivity acquisition unit 41 displays a flashing light on a display screen. FIG. 10 illustrates an example of such flashing light on a display screen. In the region indicated by a flashing light display unit, a test image formed based on the luminous frequency selected by the luminous frequency adjustment unit is displayed. The luminous frequency can be adjusted by operating the luminous frequency adjustment unit. For example, the user operates the luminous frequency adjustment unit with a mouse or the like to adjust the luminous frequency of the flashing light. The perceptual sensitivity acquisition unit 41 allows selecting the luminous frequency of the flashing light perceived to be the brightest by the user.

Depending on adjustment of the luminous frequency, the perceptual sensitivity acquisition unit 41 changes the luminous intensity. For example, depending on change of the luminous frequency, the perceptual sensitivity acquisition unit 41 changes a single luminous intensity, so that the driving power per unit time is maintained at the same level. Further, based on the selection of the luminous frequency of the flashing light which is perceived to be the brightest by the user, the perceptual sensitivity acquisition unit 41 determines an evaluation value regarding brightness for each luminous frequency.

Figure 11:
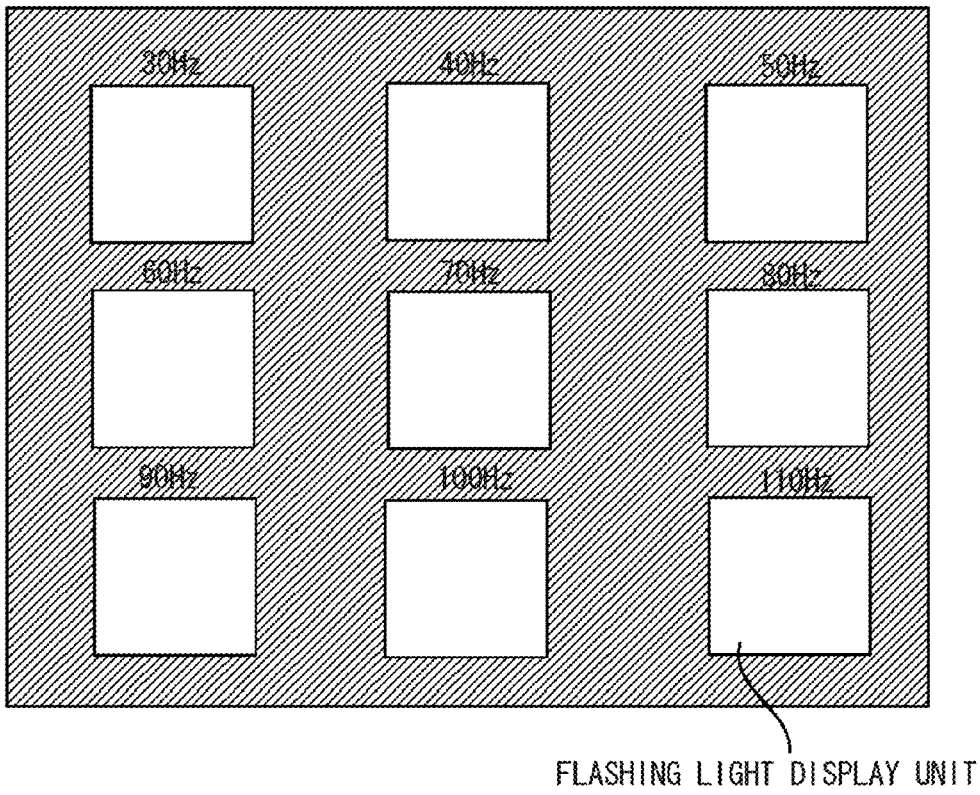
FIG. 11 illustrates another example of the display screen for acquiring observers' perceptual sensitivity to brightness.

As another method for acquiring users' perceptual sensitivity to brightness, for example, as shown in FIG. 11, a plurality of test images are displayed in the display screen, each at a different luminous frequency, and the user is allowed to select the luminous frequency forming the brightest image among the test images. The user inputs evaluation values regarding brightness for the plurality of test images. Namely, the perceptual sensitivity acquisition unit 41 receives evaluation values regarding brightness of display images for each frame rate.

Alternatively, the perceptual sensitivity to brightness may be acquired with respect to the luminous frequency, based on the subjective evaluation test using a fixed light and a flashing light as described in the first exemplary embodiment with the FIG. 4. After acquiring the perceptual sensitivity information, the perceptual sensitivity acquisition unit 41 outputs the information to the storage unit 42 and the luminous frequency determination unit 43.

The storage unit 42 stores the perceptual sensitivity information acquired by the perceptual sensitivity acquisition unit 41 for each user. For example, the storage unit 42 stores the luminous frequency forming the brightest display screen perceived by the user and evaluation values of the perceptual sensitivity to brightness for each luminous frequency.

The luminous frequency determination unit 43 identifies the luminous region of the image displayed based on an input image signal. The method for determining the luminous region is similar to that used by the luminous region identification unit 11 of the first exemplary embodiment. After identifying the luminous region, the luminous frequency determination unit 43 determines the driving frequency of the luminous region. The luminous frequency determination unit 43 determines the driving frequency of the luminous region based on the user-specific evaluation values of brightness acquired by the perceptual sensitivity acquisition unit 41. For example, the luminous frequency determination unit 43 determines the driving frequency of the display screen, so that a luminous frequency forming the brightest display screen perceived by the user can be obtained. Alternatively, for example, when an evaluation value of the luminous frequency corresponding to the frame rate of an input image signal is higher than a threshold value, an image may be displayed at the frame rate of the input image signal. In this way, processing required for changing the frame rate can be reduced.

The luminous frequency determination unit 43 outputs region information for identifying the luminous region, and the driving frequency of each region to the luminous intensity determination unit 44. Depending on the region information for determining the luminous region and the driving frequency of each region, the luminous intensity determination unit 44 controls the luminous intensity of the display screen in a way similar to the luminous intensity determination unit 13 of the first exemplary embodiment.

Thus, according to the invention of the present exemplary embodiment, control of the driving frequency that further complies with users' perceptual sensitivity to brightness can be achieved. In this way, an image can be displayed in which a region that needs to be brightly displayed can be perceived to be even brighter.

Aspects of the present invention can also be realized by a computer of a system or apparatus (or devices such as a CPU or micro-processing unit (MPU)) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. The program includes computer-executable instructions for implementing the present invention. For this purpose, the program is provided to the computer for example via a network or from a recording medium of various types serving as the memory device (e.g., computer-readable storage medium). In such a case, the system or apparatus, and the recording medium where the program is stored, are included as being within the scope of the present invention. In such a case, the system or apparatus, and the recording medium where the program is stored, are included as being within the scope of the present invention.

An operating system (OS) or other application software running on a computer can execute part or all of actual processing based on instructions of the program to realize the functions one or more of the above-described exemplary embodiments.

Additionally, the program read out of a storage medium can be written into a memory of a function expansion card inserted in a computer or into a memory of a function expansion unit connected to the computer. In this case, based on instructions of the program, a CPU or MPU provided on the function expansion card or the function expansion unit can execute part or all of the processing to realize the functions of one or more of the above-described exemplary embodiments.

A wide variety of storage media may be used to store the program. The storage medium may be, for example, any of a flexible disk (floppy disk), a hard disk, an optical disk, a magneto-optical disk, a compact disc (CD), a digital versatile disc (DVD), a read only memory (ROM), a CD-recordable (R), a CD-rewritable, a DVD-recordable, a DVD-rewritable, a magnetic tape, a nonvolatile memory card, a flash memory device, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-298178, filed Nov. 21, 2008 which is hereby incorporated by reference herein in its entirety.

What is claimed is:

1. A display control apparatus controlling luminous intensity in a display screen so that a luminous intensity of a first region of the display screen, in which an image based on an input image signal is displayed at a first frame rate, is higher than luminous intensity of a second region of the display screen in which the image based on the input image signal is displayed at a second frame rate at a same time that the first region is displayed at the first frame rate, the second frame rate higher than the first frame rate, the display control apparatus comprising:

an identification unit configured to identify pixels showing luminosity higher than a predetermined value within the image based on the input image signal; and a determination unit configured to determine the first region displayed at the first frame rate and the second region displayed at the second frame rate, depending on location of the pixels showing luminosity higher than the predetermined value.

2. The display control apparatus according to claim 1, wherein, among the pixels showing luminosity higher than the predetermined value, when the number of the pixels adjacent to each other is less than a predetermined number of pixels, the determination unit determines that the region is to be displayed at the first frame rate.

3. The display control apparatus according to claim 1 further comprising an acquisition unit configured to acquire ambient brightness of a display device displaying the image based on the input image signal, wherein, when the acquired brightness is a first brightness, the determination unit determines a region that is displayed at the first frame rate when the acquired brightness is a second brightness, which is greater than the first brightness, to be a region displayed at a third frame rate lower than the first frame rate.

4. The display control apparatus according to claim 1 further comprising an input unit configured to receive an input evaluation value concerning brightness of a display image for each frame rate, wherein the determination unit determines the first frame rate depending on the input evaluation value.

5. The display control apparatus according to claim 1, wherein the second frame rate is an integer multiple of the first frame rate.

6. The display control apparatus according to claim 1, wherein there are more than two frame rates being used to display information on the display screen at the same time.

7. The display control apparatus according to claim 1, wherein the determination unit outputs a signal that drives the first region displayed at the first frame rate at the first frame rate and the second region displayed at the second frame rate at the second frame rate.

8. The display control apparatus according to claim 1, wherein the determination unit comprises a first determination unit that determines and controls the frame rate of each region and a second determination unit that controls the luminous intensity of each region.

9. The display control apparatus according to claim 8, wherein the first and second determination units control both the frame rate and the luminous intensity for one of the regions so that the perceived luminous intensity of said one of the regions is changed and driving power per unit time is maintained at substantially the same level.

10. A display control apparatus controlling luminous intensity in a display screen so that a luminous intensity of a first region of the display screen, in which an image based on an input image signal is displayed at a first frame rate, is higher than luminous intensity of a second region of the display screen in which the image based on the input image signal is displayed at a second frame rate at a same time that the first region is displayed at the first frame rate, the second frame rate higher than the first frame rate, the display control apparatus comprising:

an identification unit configured to identify pixels, within the image based on the input image signal, showing luminosity equal to or greater than a first value and pixels showing luminosity equal to or less than a second value that is lower than the first value; and a determination unit configured to determine, when the number of pixels showing luminosity equal to or less than the second value is equal to or greater than a predetermined number, the first region displayed at the first frame rate and the second region displayed at the second frame rate, depending on location of the pixels showing luminosity equal to or higher than the first value.

11. A display control method executed by a display control apparatus controlling luminous intensity in a display screen so that a luminous intensity of a first region of the display screen, in which an image based on an input image signal is displayed at a first frame rate, is higher than luminous intensity of the display screen in which the image based on the input image signal is displayed at a second frame rate at a same time that the first region is displayed at the first frame rate, the second frame rate that is higher than the first frame rate, the display control method comprising:

identifying pixels showing luminosity higher than a predetermined value within the image based on the input image signal; and determining the first region displayed at the first frame rate and the second region displayed at the second frame rate, depending on location of the pixels showing luminosity higher than a predetermined value.

12. A non-transitory computer-readable storage medium storing a program executable by a computer controlling luminous intensity in a display screen so that luminous intensity of a first region of the display screen, in which an image based on an input image signal is displayed at a first frame rate, is higher than luminous intensity of a second region of the display screen in which the image based on the input image signal is displayed at a second frame rate at a same time that the first region is displayed at the first frame rate, the second frame rate higher than the first frame rate, the program comprising:

computer-executable instructions that cause the computer to identify pixels showing luminosity higher than a predetermined value in the image based on the input image signal; and computer-executable instructions that cause the computer to determine the first region displayed at the first frame rate and the second region displayed at the second frame rate, depending on location of the pixels showing luminosity higher than a predetermined value.

13. A display control method executed by a display control apparatus controlling luminous intensity in a display screen so that luminous intensity of a first region of the display screen, in which an image based on an input image signal is displayed at a first frame rate, is higher than a luminous intensity of a second region of the display screen in which the image based on the input image signal is displayed at a second frame rate at a same time that the first region is displayed at the first frame rate, the second frame rate higher than the first frame rate, the display control method comprising:

identifying pixels showing luminosity equal to or greater than a first value and pixels showing luminosity equal to or less than a second value that is lower than the first value in the image based on the input image signal; and determining, when the number of pixels showing luminosity equal to or less than the second value is equal to or greater than a predetermined number, the first region displayed at the first frame rate and the second region displayed at the second frame rate, depending on location of the pixels showing luminosity equal to or higher than the first value.

14. A non-transitory computer-readable storage medium storing a program executable by a computer controlling luminous intensity in a display screen so that luminous intensity of a first region of the display screen, in which an image based on an input image signal is displayed at a first frame rate, is higher than luminous intensity of a second region of the display screen in which the image based on the input image signal is displayed at a second frame rate at a same time that the first region is displayed at the first frame rate, the second frame rate higher than the first frame rate, the program comprising:

computer-executable instructions that cause the computer to identify pixels showing luminosity equal to or greater than a first value and pixels showing luminosity equal to or less than a second value that is lower than the first value within the image based on the input image signal; and computer-executable instructions that cause the computer to determine, when the number of pixels showing luminosity equal to or less than the second value is equal to or greater than a predetermined number, the first region displayed at the first frame rate and the second region displayed at the second frame rate, depending on location of the pixels showing luminosity equal to or higher than the first value.

* * * * *